US010234212B2

(12) United States Patent
Noel-Baron

(10) Patent No.: US 10,234,212 B2
(45) Date of Patent: Mar. 19, 2019

(54) HEAT TRANSFER PLATE AND PLATE HEAT EXCHANGER

(71) Applicants: ALFA LAVAL CORPORATE AB, Lund (SE); ALFA LAVAL VICARB SAS, St. Egreve (FR)

(72) Inventor: Olivier Noel-Baron, Echirolles (FR)

(73) Assignees: ALFA LAVAL CORPORATE AB, Lund (SE); ALFA LAVAL VICARB SAS, St. Egreve (FR)

( * ) Notice: Subject to any disclaimer, the term of this patent is extended or adjusted under 35 U.S.C. 154(b) by 0 days.

(21) Appl. No.: 15/505,504

(22) PCT Filed: Aug. 21, 2015

(86) PCT No.: PCT/EP2015/069239

§ 371 (c)(1),
(2) Date: Feb. 21, 2017

(87) PCT Pub. No.: WO2016/026958

PCT Pub. Date: Feb. 25, 2016

(65) Prior Publication Data

US 2017/0254596 A1 Sep. 7, 2017

(30) Foreign Application Priority Data

Aug. 22, 2014 (EP) ..... 14181947
Sep. 15, 2014 (EP) ..... 14184805

(51) Int. Cl.
*F28F 3/00* (2006.01)
*F28D 9/00* (2006.01)
(Continued)

(52) U.S. Cl.
CPC ..... *F28D 9/005* (2013.01); *F28D 1/035* (2013.01); *F28D 9/0006* (2013.01);
(Continued)

(58) Field of Classification Search
CPC ..... F28D 9/005; F28D 1/035; F28D 9/006; F28D 9/0012; F28D 9/0043; F28D 1/02;
(Continued)

(56) References Cited

U.S. PATENT DOCUMENTS 4,066,121 A 1/1978 Kleine et al.
4,359,087 A * 11/1982 Johansson ..... F28F 3/083 165/167

(Continued)

FOREIGN PATENT DOCUMENTS

CN 102859312 A 1/2013
CN 103547878 A 1/2014

(Continued)

OTHER PUBLICATIONS

International Search Report (PCT/ISA/210) dated Nov. 10, 2015, by the European Patent Office as the International Searching Authority for International Application No. PCT/EP2015/069239.

(Continued)

*Primary Examiner* — Davis D Hwu
(74) *Attorney, Agent, or Firm* — Buchanan Ingersoll & Rooney PC

(57) ABSTRACT

A heat transfer plate comprising a first port opening and a second port opening for allowing a first fluid to flow over a top surface of the heat transfer plate, a first side opening and an opposite, second side opening for allowing a second fluid to flow over a bottom surface of the heat transfer plate, a number of rows of alternating tops and grooves that extend along the heat transfer plate, where a transition between a top and an adjacent groove is formed by an inclined portion, and plate portions that extend along the heat transfer plate, between the rows of tops and grooves, thereby forming flow channels between the rows of tops and grooves.

18 Claims, 8 Drawing Sheets

(51) Int. Cl.

| | |
|---|---|
| ***F28F 3/04*** | (2006.01) |
| ***F28D 1/03*** | (2006.01) |
| ***F28F 3/02*** | (2006.01) |
| *F28D 1/02* | (2006.01) |

(52) U.S. Cl.
CPC ..... *F28D 9/0012* (2013.01); *F28D 9/0043* (2013.01); *F28F 3/027* (2013.01); *F28F 3/044* (2013.01); *F28F 3/046* (2013.01); *F28D 1/02* (2013.01); *F28D 9/0031* (2013.01); *F28F 3/02* (2013.01)

(58) Field of Classification Search
CPC .. F28F 3/027; F28F 3/044; F28F 3/046; F28F 3/083
USPC ..... 165/166
See application file for complete search history.

(56) References Cited

U.S. PATENT DOCUMENTS

| | | | |
|---|---|---|---|
| 4,781,248 | A | 11/1988 | Pfeiffer |
| 2003/0000688 | A1 | 1/2003 | Mathur et al. |
| 2014/0131025 | A1 | 5/2014 | Blomgren |

FOREIGN PATENT DOCUMENTS

| | | | |
|---|---|---|---|
| CN | 103958999 | A | 7/2014 |
| DE | 35 36 316 | A1 | 4/1987 |
| EP | 0 177 474 | A2 | 4/1986 |
| EP | 0 177 474 | A3 | 10/1986 |
| EP | 1 001 240 | A1 | 5/2000 |
| EP | 1 070 928 | A1 | 1/2001 |
| EP | 2 267 391 | A2 | 12/2010 |
| EP | 2 508 831 | A1 | 10/2012 |
| EP | 2 527 775 | A1 | 11/2012 |
| EP | 2 267 391 | A3 | 2/2014 |
| EP | 2 728 292 | A1 | 5/2014 |
| FR | 813 272 | A | 5/1937 |
| FR | 2 426 879 | A1 | 12/1979 |
| JP | S50-128162 | U | 10/1975 |
| JP | S56-140786 | U | 10/1981 |
| JP | 57-073393 | A | 5/1982 |
| JP | S58-502016 | A | 11/1983 |
| JP | S63-025494 | A | 2/1988 |
| JP | H01-503254 | A | 11/1989 |
| JP | 05-090167 | U | 12/1993 |
| JP | H07-260384 | A | 10/1995 |
| JP | H08-094276 | A | 4/1996 |
| JP | H08-271171 | A | 10/1996 |
| JP | 09-138082 | A | 5/1997 |
| JP | H10-267580 | A | 10/1998 |
| JP | H11-248392 | A | 9/1999 |
| JP | 2000-146469 | A | 5/2000 |
| JP | 2006-183945 | A | 7/2006 |
| JP | 2007-528978 | A | 10/2007 |
| JP | 2012-512377 | A | 5/2012 |
| JP | 2013-029296 | A | 2/2013 |
| JP | 2013-527418 | A | 6/2013 |
| KR | 10-2002-006158 | A | 7/2002 |
| WO | 83/01998 | A1 | 6/1983 |
| WO | 88/08508 | A1 | 11/1988 |
| WO | 2005/088221 | A1 | 9/2005 |
| WO | 2008/024066 | A1 | 2/2008 |
| WO | 2010/069756 | A1 | 6/2010 |
| WO | 2011/133087 | A2 | 10/2011 |
| WO | 2013/078530 | A1 | 6/2013 |

OTHER PUBLICATIONS

Written Opinion (PCT/ISA/237) dated Nov. 10, 2015, by the European Patent Office as the International Searching Authority for International Application No. PCT/EP2015/069239.

International Preliminary Report of Patentability (PCT/IPEA/Form409) dated Sep. 14, 2016 as the International Preliminary Examining Authority for International Application No. PCT/EP2015/069239.

English language translation of Korean Office Action dated Apr. 20, 2018 issued by the Korean Patent Office in corresponding Korean Patent Application No. 10-2017-7007392 (4 pages).

Office Action (Notice of Reasons for Rejection) dated Jun. 4, 2018, by the Japanese Patent Office in corresponding Japanese Patent Application No. 2017-510471 and an English Translation of the Office Action. (17 pages).

Office Action (The First Office Action) dated Jul. 4, 2018, by the State Intellectual Property Office of People's Republic of China in corresponding Chinese Patent Application 201580044955.X and an English Translation of the Office Action. (9 pages).

* cited by examiner

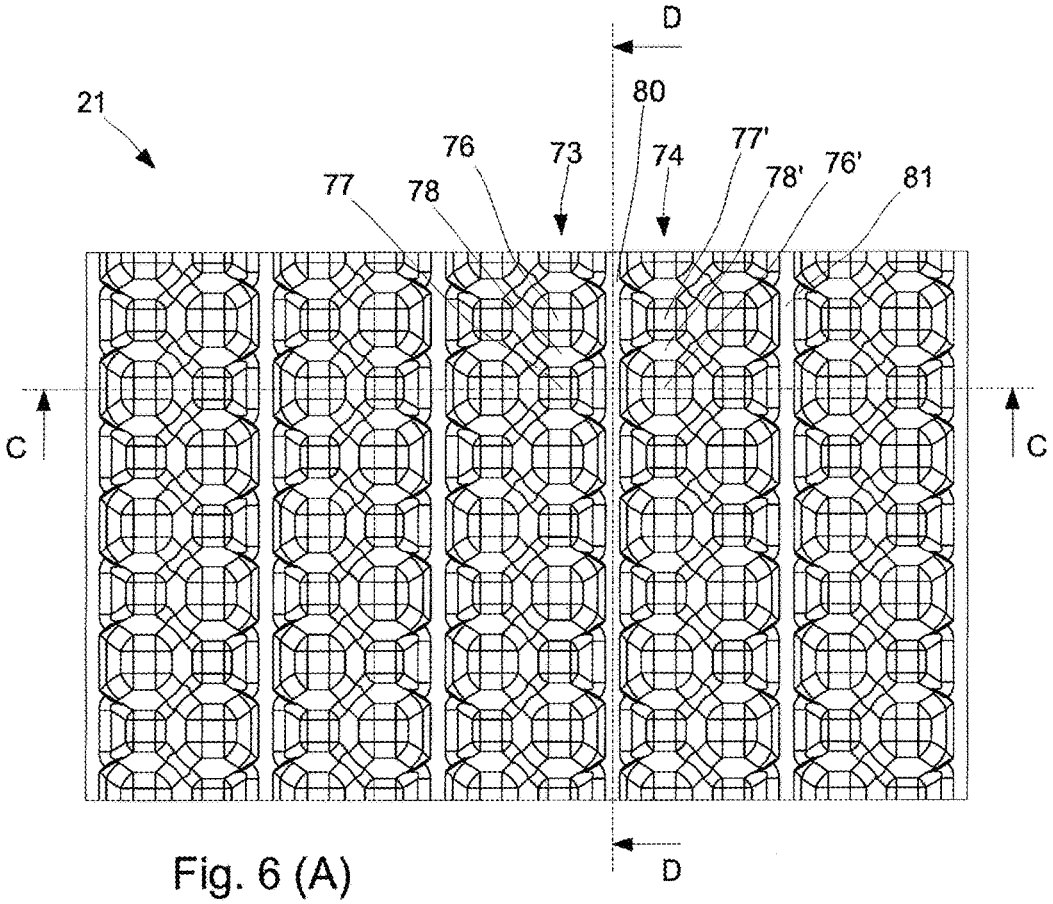
Fig. 6 (A)
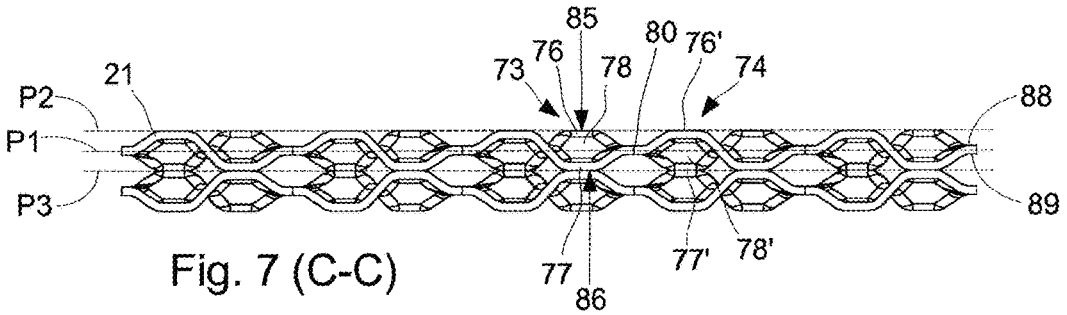
Fig. 7 (C-C)
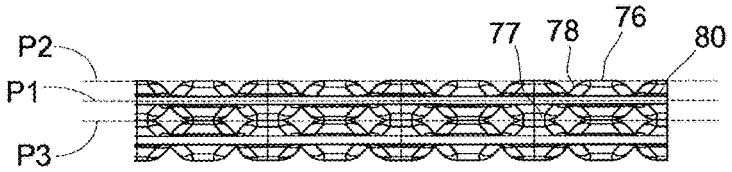
Fig. 8 (D-D)

HEAT TRANSFER PLATE AND PLATE HEAT EXCHANGER

TECHNICAL FIELD

The invention relates to a heat transfer plate with a so called roller coaster pattern, which comprises a number of rows where each row has alternating tops and grooves that extend along a central plane of the heat transfer plate, between a top plane and a bottom plane of the heat transfer plate. The top plane and bottom plane are substantially parallel to the central plane and are located on a respective side of the central plane, where a transition between each top and adjacent groove in the same row is formed by a portion of the heat transfer plate that is inclined relative the central plane.

BACKGROUND ART

Today many different types of plate heat exchangers exist and are employed in various applications depending on their type. Some types of plate heat exchangers have a casing that forms a sealed enclosure in which heat transfer plates that are joined are arranged. The heat transfer plates form a stack of heat transfer plates where alternating first and second flow paths for a first and a second fluid are formed in between the heat transfer plates.

Since the heat transfer plates are surrounded by a casing, the heat exchanger may withstand high pressure levels in comparison with many other types of plate heat exchangers. Some examples of heat exchangers with a casing that surrounds heat transfer plates are found in patent documents EP2508831 and EP2527775. The plate heat exchangers disclosed by these documents handle high pressure levels well. However, in some applications the casing has to be relatively thick to be able to handle the desired pressure levels, which increases the total weight as well as the overall cost of the heat exchanger. Also, the heat transfer plates within the casing must be designed for withstanding high pressure levels. However, at the same time the heat transfer plates must be able to efficiency transfer heat. Generally, the heat transfer plates are of a so called chevron type, i.e. have a pattern with a set of elongated ridges and grooves that are inclined to another set of elongated ridges and grooves (sometimes referred to as herringbone pattern).

New types of plate heat exchangers as well as heat transfer plates that may withstand high pressure levels are needed. The heat exchangers and heat transfer plates should preferably require relatively little material for their structure while still ensuring the heat is efficiently transferred between the heat transfer plates.

SUMMARY

It is an object of the invention to at least partly overcome one or more of the above-identified limitations of the prior art. In particular, it is an object to provide a new heat transfer plate that may withstand high pressure levels while still enabling efficient transfer of heat. Still other objectives, features, aspects and advantages of the invention will appear from the following detailed description as well as from the drawings.

Thus, a heat transfer plate is provided, which is configured to be arranged in a plate heat exchanger and comprises: a first side, a second side, a third side and a fourth side that form a periphery of the heat transfer plate, the first side being opposite to the second side and the third side being opposite to the fourth side; a first port opening and a second port opening that are arranged at a distance from each other for allowing a first fluid to flow over a top surface of the heat transfer plate, from the first port opening to the second port opening, wherein an axis of the heat transfer plate extends through a center of the first port opening and through a center of the second port opening; a first side opening at the first side and a second side opening at the second side, for allowing a second fluid to flow over a bottom surface of the heat transfer plate, from the first side opening to the second side opening; and a number of rows where each row has alternating tops and grooves that extend along a central plane of the heat transfer plate, between a top plane and a bottom plane of the heat transfer plate, the top plane and bottom plane being substantially parallel to the central plane and located on a respective side of the central plane, where a transition between a top and an adjacent groove in the same row is formed by a portion of the heat transfer plate that is inclined relative the central plane.

The heat transfer plate has plate portions that extend along the central plane of the heat transfer plate, between the rows of tops and grooves, such that at least some of the rows of tops and grooves are separated from each other and the plate portions thereby form flow channels between the rows of tops and grooves.

The heat transfer plate has, by virtue of the flow channels between the rows of tops and grooves, a so called roller coaster pattern. The heat transfer plate is advantageous in that it provides strength to the plate portions that form flow channels. Heat transfer plates with traditional plate profiles, such as those of chevron type, tend to flatten under pressure. The roller coaster pattern, on the other hand, is able to maintain a constant gap between adjacent plates at relatively higher pressure levels.

The heat transfer plate may have the shape of a circular plate with two cut sides that form the first side and the second side, wherein the third side and the fourth side have the form of curved sides.

This shape is advantageous e.g. in that it allows a flow of fluid through the port openings and over the side openings in a so called multipass configuration (the flows turns in the opposite directions) without the need of any additional flow diverter. Also, the shape may easily match an internal side of a heat exchanger shell in which the plate is arranged, and may offer good flow distribution over the two cut sides.

At least three of the rows of tops and grooves may extend adjacent each other, symmetrically along the axis that extends through the centers of the first and second port openings, thereby forming a central set of axially extending rows of tops and grooves.

A number of the rows of tops and grooves may extend in a direction radially outwards from a center of the first port opening, thereby forming radially extending rows of tops and grooves.

The radially extending rows of tops and grooves may surround a circumference of the first port opening.

A number of the rows of tops and grooves may extend in a longitudinal direction, parallel to the axis that extends through the centers of the first and second port openings, thereby forming longitudinally extending rows of tops and grooves.

The above described extensions of rows of tops and grooves all contribute, alone and in combination, to a good distribution of fluids over the both sides of the heat transfer plate. Tests have shown that it is possible to accomplish full or nearly full wetting (flow of fluid) of a heat transfer area of the plate.

A number of the rows of tops and grooves may extend in parallel to the third side and with a curvature, thereby forming curved rows of tops and grooves.

The curved rows of tops and grooves are advantageous in that it creates an umbrella-shaped distribution of fluid from the port opening that is located closest to the third side, which facilitates a uniform distribution of fluid across the heat transfer plate.

The heat transfer plate may comprise a first side row of tops that are located along the first side opening, and a second side row of tops that are located along the second side opening, wherein the tops of the first and second side rows have a different pitch than the tops in the rows of tops and grooves that are separated from each other by the plate portions that form flow channels.

This is advantageous in that the distribution of the second fluid that flows from the first side opening to the second side opening made be made more uniform.

The heat transfer plate may comprise a first fluid blocker and a second fluid blocker that are arranged on the top surface of the heat transfer plate and located between the first port opening and the second port opening, wherein the first fluid blocker is wedge-shaped and has a tapered section that faces the first port opening, and the second fluid blocker is wedge-shaped and has a tapered section that faces the second port opening.

The heat transfer plate may comprise a third fluid blocker and a fourth fluid blocker that are arranged on the bottom surface of the heat transfer plate, the third fluid blocker being arranged between the first port opening and the third side, across a fluid channel that extends along the third side, and the fourth fluid blocker being arranged between the second port opening and the fourth side, across a fluid channel that extends along the fourth side.

The heat transfer plate may comprise a fifth fluid blocker and a sixth fluid blocker that are arranged on the bottom surface of the heat transfer plate, the fifth fluid blocker extending along the third side, and the sixth fluid blocker extending along the fourth side. The fifth and sixth fluid blockers are advantageous in that they provide good flow distribution over the plate without the need of any additional flow diverter (such as a sleeve fitted between the plate and a plate heat exchanger casing in which the plate is arranged).

The heat transfer plate may comprise a first flow reducer and a second flow reducer that are arranged on the bottom surface of the heat transfer plate, the first flow reducer extending from the first port opening to the third side, the second flow reducer extending from the second port opening to the fourth side.

The fluid blockers and the flow reducer are, each alone or in combination, advantageous in that they ensure a uniform distribution of the fluids over the heat transfer plate, including around the port openings.

A number of the plate portions that separate the rows of tops and grooves may extend first in a direction outwards from the first port opening, then in a direction that is parallel to the third side and with a curvature, such that the plate portions comprises curved plate portions. These plate portions may continue with an extension in a direction that is parallel to a direction from the first port opening to the second port opening.

A number of the plate portions that separate the rows of tops and grooves may extend first in a radial direction outwards from the first port opening, then in a direction that is parallel to a direction from the first port opening to the second port opening, and finally in a radial direction inwards to the second port opening.

The third side may comprise two cut-outs and the fourth side comprises two cut-outs. Each of these cut-outs is arranged for receiving a respective sealing element that provides a seal between the plate and a casing of a plate heat exchanger in which the heat transfer plate is arranged. This is advantageous in that facilitates elimination of a by-pass flow of fluid between casing and the plate, without the need of any additional flow diverter. It may also provide support for the plate and any plates that are joined with the plate (to form a stack of heat transfer plates) when mounting it into the casing while still leaving some flexibility for radial, thermal expansion.

The first, second, third and fourth sides of the heat transfer plate may be configured to be sealed with corresponding sides of a similar heat transfer plate that is located at the top side of the heat transfer plate, and the first and second openings may configured to be sealed with corresponding openings of a similar heat transfer plate that is located at a bottom side of the heat transfer plate.

According to another aspect a heat exchanger is provided, which comprises a number of heat transfer plates that correspond to the heat transfer plate described above, including any of the above described features. The heat transfer plates are arranged within a casing and are permanently joined to each other such that: a first set of flow channels for a first fluid is formed by every second interspace between the heat transfer plates, with fluid entries and fluid exits at the first and the second port openings; a second set of flow channels for a second fluid is formed by every other, second interspace between the heat transfer plates, with fluid entries and fluid exits at the first and second side openings.

A first distribution tube extends through the first port openings of the heat transfer plates and comprises a fluid outlet and a fluid inlet that are separated from each other by a first fluid blocker, also referred to as a distribution tube baffle, and a second distribution tube extends through the second port openings of the heat transfer plates and comprises a fluid inlet and a fluid outlet, the fluid inlet of the second distribution tube being arranged, as seen across the heat transfer plates, opposite the fluid outlet of the first distribution tube and the fluid outlet of the second distribution tube being arranged, as seen across the heat transfer plates, opposite the fluid inlet of the first distribution tube.

A first passage extends along the casing and the first side openings of the heat transfer plates and comprises a fluid outlet section and fluid inlet section that are separated from each other by a second fluid blocker, also referred to as a baffle, and a second passage extends along the casing and the second side openings of the heat transfer plates and comprises a fluid inlet section and a fluid outlet section, the fluid inlet section of the second passage being arranged, as seen across the heat transfer plates, opposite the fluid outlet section of the first passage and the fluid outlet section of the second passage being arranged, as seen across the heat transfer plates, opposite the fluid inlet section of the first passage.

The heat exchanger is advantageous in that it is very durable and in that it incorporates a heat transfer plate that has all the advantages of the heat transfer plate described above.

The first and second distribution tubes may extend from a top cover to a bottom cover of the casing, and are attached to the top cover and to the bottom cover.

This is advantageous in that nozzle loads are supported by the covers, which significantly reduces the stress on the heat transfer plates inside the casing. Also, the distribution tubes work as tie beams, which is advantageous in that the thickness of the covers may be reduced.

The first distribution tube may comprise a second fluid outlet that is located next to the fluid inlet of the first distribution tube and the second distribution tube may comprise a second fluid inlet that is arranged, as seen across the heat transfer plates, opposite the second fluid outlet of the first distribution tube, and that is separated from the fluid outlet of the second distribution tube by a third fluid blocker. The first passage may comprise a second fluid outlet section that is located next to the fluid inlet section of the first passage, and the second passage may comprise a second fluid inlet section that is arranged, as seen across the heat transfer plates, opposite the second fluid outlet section of the first passage, and that is separated from the fluid outlet section of the second passage by a fourth fluid blocker.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which FIG. 6 is an enlarged view of section A in FIG. 5, FIG. 7 is a cross-sectional side view as seen along line C-C in FIG. 7, when the heat transfer plate is arranged on top of a similar heat transfer plate, FIG. 8 is a cross-sectional side view as seen along line D-D in FIG. 7, when the heat transfer plate is arranged on top of a similar heat transfer plate.

DETAILED DESCRIPTION

Figure 1:
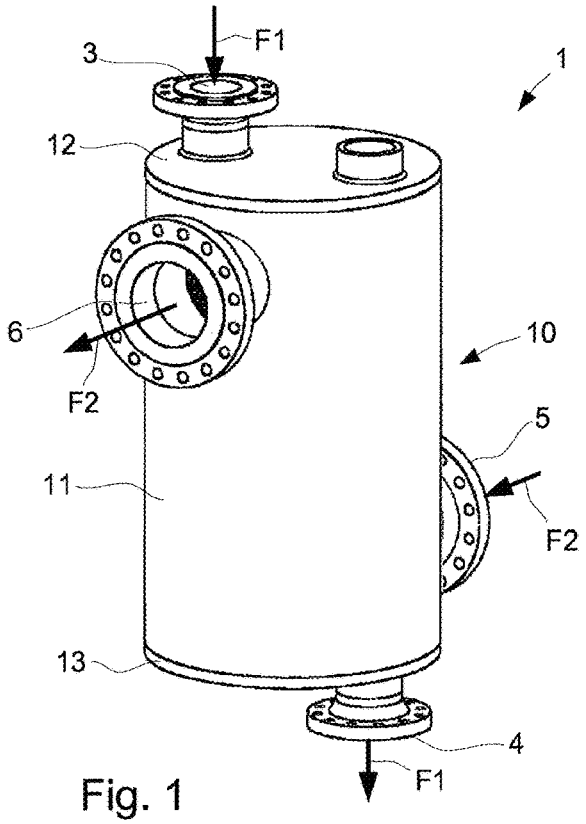
FIG. 1 is a perspective view of a plate heat exchanger.
Figure 2:
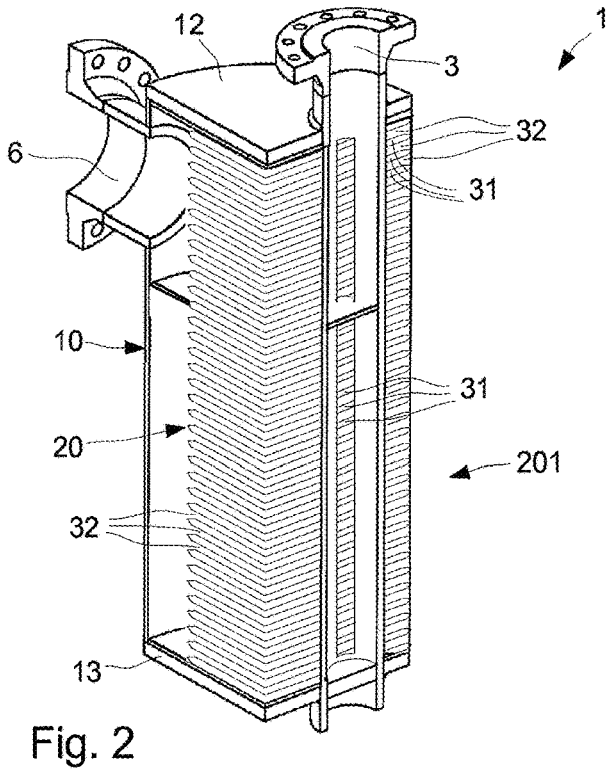
FIG. 2 is a cross-sectional, perspective view of the heat exchanger of FIG. 1, with the cross-sectional views seen along an inlet for a first fluid and an outlet for a second fluid.

With reference to FIGS. 1 and 2 a plate heat exchanger 1 is illustrated. All illustrated parts of the plate heat exchanger 1 are generally made of metal. Some parts like conventional gaskets may be made of other materials. The plate heat exchanger 1 has a casing 10 in the form of a cylindrical casing 11 that is sealed by a top cover 12 and a bottom cover 13, such that a sealed enclosure is formed within the casing 10. The plate heat exchanger 1 has in the top cover 12 a first heat exchanger inlet 3 for a first fluid F1 and has in the bottom cover 13 a first heat exchanger outlet 4 for the first fluid F1. A second heat exchanger inlet 5 for a second fluid F2 is arranged in the cylindrical casing 11, at an end of the cylindrical casing 11 that is proximate the bottom cover 13. A second heat exchanger outlet 6 for the second fluid F2 is arranged in the cylindrical casing 11, at an end of the cylindrical casing 11 that is proximate the top cover 12. Each of the inlets 3, 5 and outlets 4, 6 has a flange that facilitates connection of the inlets 3, 5 and outlets 4, 6 to pipes that may convey the first fluid F1 and the second fluid F2.

A number of heat transfer plates 20 are arranged within the casing 10 and are permanently joined to each other, for example by welding, to form a stack of heat transfer plates 201, such that interspaces are formed between the heat transfer plates in the stack 201. Every second interspace between the heat transfer plates 20 forms a first set of flow channels 31 for the first fluid F1, while every other, second interspace between the heat transfer plates 20 forms a second set of flow channels 32 for the second fluid F2.

Figure 5:
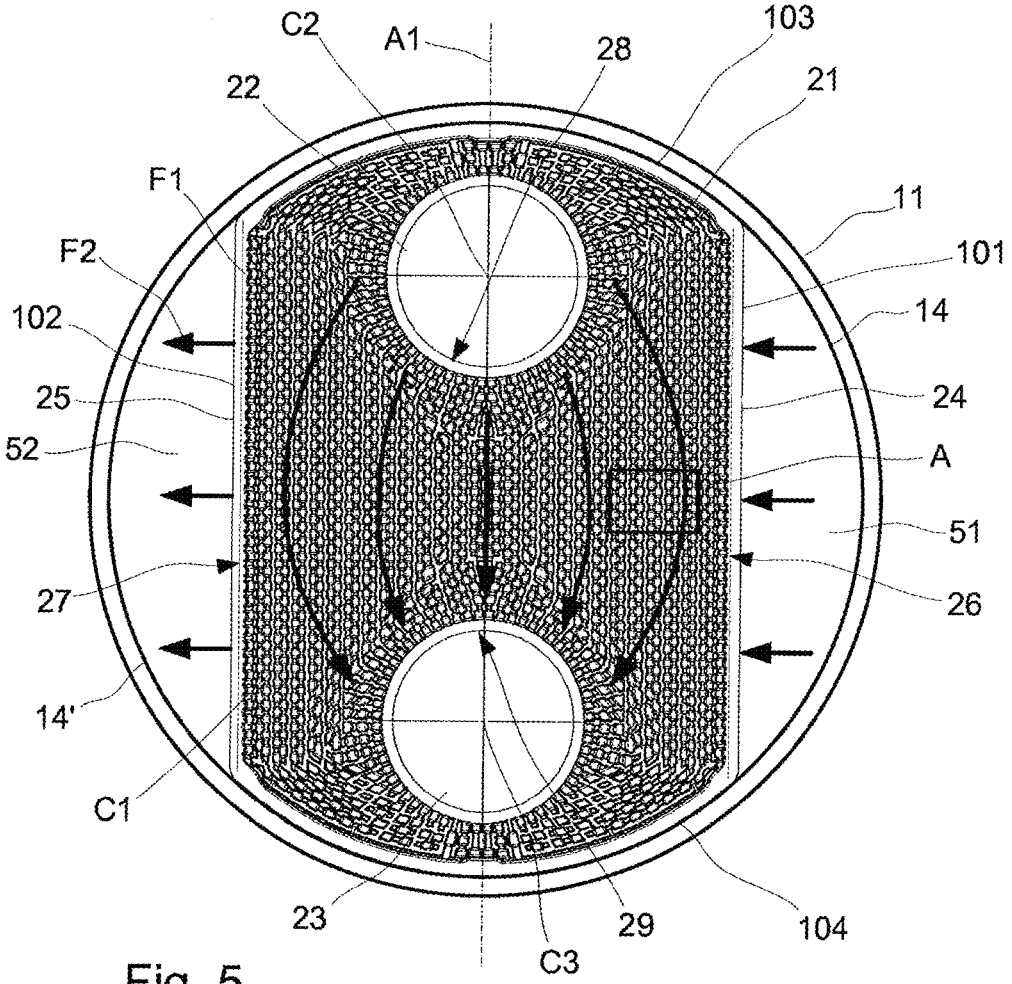
FIG. 5 is a cross-sectional top view of the heat exchanger of FIG. 1, showing a heat transfer plate that is arranged in the heat exchanger.

With further reference to FIG. 5 a heat transfer plate 21 is shown. The heat transfer plates 20 within the casing 10 may each be of the same type as the heat transfer plate 21. Thus, every one or some heat transfer plate in the stack 201 may have the form of the heat transfer plate 21 shown in FIG. 5. However, every second heat transfer plate in the stack 201 may be rotated 180° about an axis A1 that is parallel to the heat transfer plate 21 and that extends through a center C1 of the heat transfer plate 21, through a center C2 of a first port opening 22 and through a center C3 of a second port opening 23. The port openings 22, 23 are located at a distance from each other for allowing the first fluid F1 to flow over a top surface 88 (see FIG. 7) of the heat transfer plate 21, from the first port opening 22 to the second port opening 23 or in the opposite direction.

The heat transfer plate 21 has a first side 101, a second side 102, a third side 103 and a fourth side 104 that form a periphery of the heat transfer plate 21. The first side 101 is opposite to the second side 102 and the third side 103 is opposite to the fourth side 104. As may be seen from FIG. 5, the heat transfer plate 21 has the shape of a circular plate with two cut sides that form the first side 101 and the second side 102. The third side 103 and the fourth side 104 have the form of curved sides. Specifically, the third side 103 and the fourth side 104 form a respective circular arc with its centers in the center C1 of the heat transfer plate 21.

To accomplish the first set of flow channels 31 and the second set of flow channels 32, the first port opening 22 and the second port opening 23 of a heat transfer plate 21 in the stack 201 is welded to similar first and second port openings of a first, adjacent (upper) heat transfer plate, around their entire peripheries such that a flow boundary is formed for the second fluid F2. Additionally, the entire periphery of the heat transfer plate 21 in the stack 201 is welded to similar periphery of a second, adjacent (lower) heat transfer plate. The first fluid F1 may then enter the heat transfer plates 20 only via first port openings 22 and second port openings 23 of the heat transfer plates in the stack 201, while it cannot escape outside the periphery of the heat transfer plates 20. The second fluid F2 may enter the heat transfer plates 20 at their peripheries but will not flow into the port openings since they are sealed.

Thus, the heat transfer plates 20 are joined to each other alternatively at their ports respectively at their peripheries. The space, or channels, formed between the heat transfer plates 20 are referred to as interspaces. This is done for all plates in the stack 201, and means that the first, second, third and fourth sides 101, 102, 103, 104 are sealed with corresponding sides of a similar heat transfer plate that is located at a top side of the heat transfer plate. The first and second port openings 22, 23 are sealed with corresponding openings of a similar heat transfer plate that is located at a bottom side of the heat transfer plate.

The first set of flow channels 31 for the first fluid F1 is then formed between every second interspace between the heat transfer plates 20, with fluid entries 28 at the first port opening 22 and fluid exits 29 at the second port openings 23. When the flow of the first fluid F1 over a heat transfer plate 21 is reversed, then the fluid entry 28 at the first port opening 22 becomes a fluid exit and the and the fluid exit 29 at the second port opening 23 becomes a fluid entry.

The second set of flow channels 32 for the second fluid F2 is formed between every other, second interspace between the heat transfer plates 20, with, for every heat transfer plate, a fluid entry 26 at a first side opening 24 at the first side 101 and a fluid exit 27 at a second side opening 25 at the second side 102. When the flow of the second fluid F2 over a heat transfer plate 21 is reversed, then the fluid entry 26 at the first side 101 becomes a fluid exit and the and the fluid exit 27 at the second side 102 becomes a fluid entry. Thus, the first side opening 24 and the second side opening 25 allow the second fluid F2 to flow over a bottom surface 89 (see FIG. 7) of the heat transfer plate 21, from the first side opening 24 to the second side opening 25 or in the opposite direction.

As will be further shown below, the flow direction of the first fluid F1 is for some of the heat transfer plates in the stack 201 opposite that of some of the other heat transfer plates, which means that the first set of flow channels 31 has fluid entries at the first port openings 22 and exits and the second port openings 23, or entries at the second port openings 23 and exits at the first port openings 22, depending on at which port opening the first fluid F1 enters (depending on the flow direction of the first fluid F1). In a similar manner, the flow direction of the second fluid F2 is for some of the heat transfer plates in the stack 201 opposite that of some of the other heat transfer plates. This means that the second set of flow channels 32 has fluid entries at the first sides 101 and exits at the second sides 102, or entries at the second sides 102 and exits at the first sides 101, depending on at which side the second fluid F2 enters (depending on the flow direction of the second fluid F2).

Figure 3:
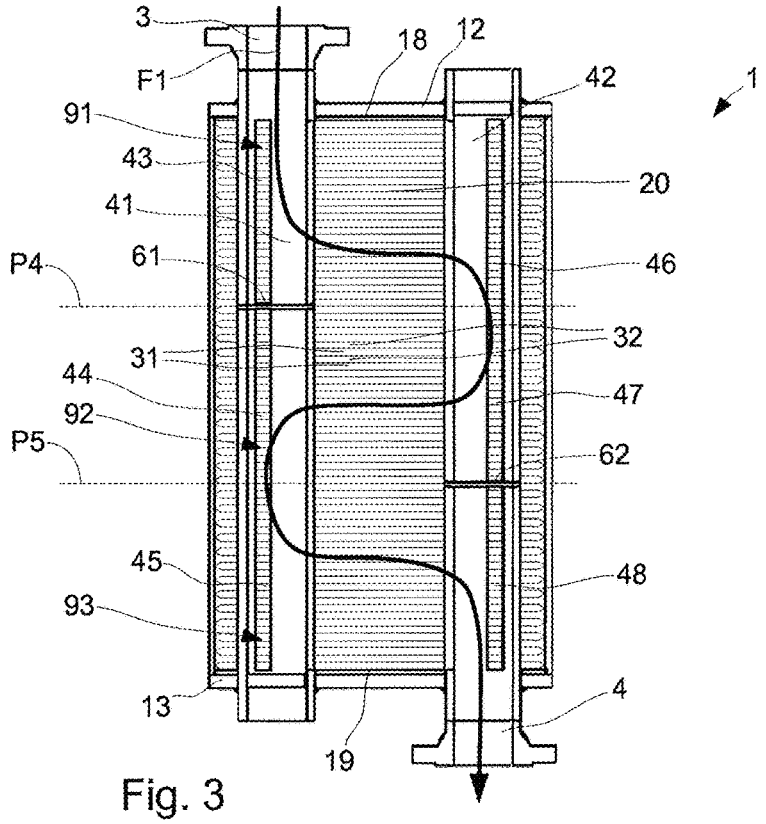
FIG. 3, is a cross-sectional view of the heat exchanger of FIG. 1, showing a flow path of the first fluid.

With reference to FIG. 3, the plate heat exchanger 1 has a first distribution tube 41 that extends through the first port openings 22 of the heat transfer plates 20. The first distribution tube 41 and has a fluid outlet 43 and fluid inlet 44 that are separated from each other by a first fluid blocker 61. Each of the fluid outlet 43 and the fluid inlet 44 of the first distribution tube 41 has the shape of an elongated opening, or through hole, that extends along a respective length of the first distribution tube 41. The first fluid blocker 61 has the shape of disc that is, at a peripheral edge of the disc 61, welded to the interior of the first distribution tube 41, such that no fluid may flow past the first fluid blocker 61. An end of the first distribution tube 41 that extends through the top cover 12 forms the first heat exchanger inlet 3.

The plate heat exchanger 1 has second distribution tube 42 that extends through the second port openings 23 of the heat transfer plates 20. The second distribution tube 42 has a fluid inlet 46 and a fluid outlet 47. The fluid inlet 46 of the second distribution tube 42 is arranged, as seen across the heat transfer plates 20, opposite the fluid outlet 43 of the first distribution tube 41. The fluid outlet 47 of the second distribution tube 42 is arranged, as seen across the heat transfer plates 20, opposite the fluid inlet 44 of the first distribution tube 41. Each of the fluid inlet 46 and the fluid outlet 47 of the second distribution tube 42 has the shape of an elongated opening, or through hole, that extends along a respective length of the second distribution tube 42.

In this context, "across the heat transfer plates" may refer to a first direction from the first port opening 22 to the second port opening 23 of a heat transfer plate 21, or to a second direction that is opposite the first direction. These directions are parallel to a planar extension of the heat transfer plates, and to the axis A1.

The fluid outlet 43 of the first distribution tube 41 is an outlet in the sense that the first fluid F1 may, after it has entered the first distribution tube 41 via the first heat exchanger inlet 3, flow out from the first distribution tube 41 via the fluid outlet 43 and into interspaces between the heat transfer plates 20, where the fluid entries 28 of the first port openings 22 face the first distribution tube 41. Thus, all fluid entries 28 at first port openings 22 of heat transfer plates that face the fluid outlet 43 of the first distribution tube 41 will receive the first fluid F1 from the first distribution tube 41. In these interspaces the first fluid F1 flows across heat transfer plates and eventually out from the interspaces at the fluid exits 29 of the second port openings 23. The fluid thereafter flows into the fluid inlet 46 of the second distribution tube 42, thus making the fluid inlet 46 an "inlet". This applies for all heat transfer plates between plane P4 in FIG. 3 and the top cover 12.

When the first fluid F1 has flowed into the second distribution tube 42 via the fluid inlet 46, it flows further in the second distribution tube 42 and to the fluid outlet 47 where it, at the second port openings 23, leaves the second distribution tube 42 via the fluid outlet 47 (making the fluid outlet 47 act as an "outlet"). The first fluid F1 then enters interspaces between the heat transfer plates 20, at the second port openings 23 of the heat transfer plates 20 which thereby act as fluid entries. The first fluid F1 then flows in the interspaces, i.e. across heat transfer plates, exits the interspaces at the first port openings 22, which thereby act as fluid exits, and flows into the first distribution tube 41 via its fluid inlet 44. The flow of the first fluid F1 from the fluid outlet 47 of the second distribution tube 42 to the fluid inlet 44 of the first distribution tube 41 applies for all heat transfer plates that are located between plane P4 and P5 in FIG. 3.

The first distribution tube 41 has also a second fluid outlet 45 that is located next to its fluid inlet 44. The second distribution tube has a second fluid inlet 48 that is located, as seen across the heat transfer plates 20, opposite the second fluid outlet 45 of the first distribution tube 41. The second fluid inlet 48 is separated from the fluid outlet 47 of the second distribution tube 42 by a third fluid blocker 62.

Each of the second fluid outlet 45 of the first distribution tube 41 and the second fluid inlet 48 of the second distribution tube 42 has the shape of an elongated opening, or through hole, that extends along a length of the first distribution tube 41 respectively along a length of the second distribution tube 42. The third fluid blocker 62 has the shape of disc that is, at a peripheral edge of the disc, welded to the interior of the second distribution tube 42, such that no fluid may flow past the third fluid blocker 62.

After the first fluid F1 has entered the first distribution tube 41 via its fluid inlet 44, it flows further in the first distribution tube 41 and to its second fluid outlet 45. The first fluid F1 leaves the first distribution tube 41 via the second fluid outlet 45 and flows into interspaces at first port openings 22. The first fluid F1 then flows in the interspaces, across the heat transfer plates that form the interspaces, out from the interspaces via second port openings 23 of the heat transfer plates 20 and into the second distribution tube 42 via the second fluid inlet 48. The flow of the first fluid F1 from the second fluid outlet 45 of the first distribution tube 41 to the second fluid inlet 48 of the second distribution tube 42 applies for all heat transfer plates that are located between the plane P5 and the bottom cover 13. The first fluid F1 exits the second distribution tube 42 via the first heat exchanger outlet 4, which is formed by a part of the second distribution tube 42 that extends out through the bottom cover 13.

The general flow path of the first fluid F1 is illustrated by the curved arrow marked with reference numeral "F1".

As may be seen, the first and second distribution tubes 41, 42 extend from the top cover 12 to the bottom cover 13 of the casing 10. The first distribution tube 41 has an end that extends through the bottom cover 13 and the second distribution tube 42 has an end that extends through the top cover 12. The ends that extend through the covers 12, 13 are sealed such that no fluid may leak out from the plate heat exchanger 1. The first and second distribution tubes 41, 42 are both attached to the top cover 12 and to the bottom cover 13, typically by welding, which increases the pressure resistance of the plate heat exchanger 1.

A first end plate 18 is arranged between the heat transfer plates 20 and the top cover 12, and a second end plate 19 is arranged between the heat transfer plates 20 and the bottom cover 13. Each of the first and second distribution tubes 41, 42 are welded to the end plates 18, 19, typically at ports of the end plates through which the distributions tubes 41, 42 extends.

Figure 4:
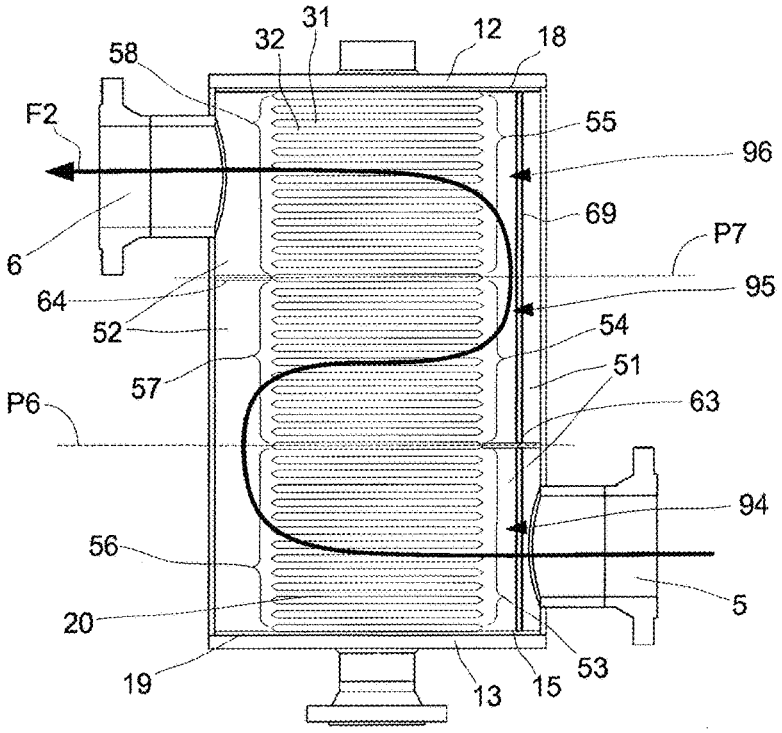
FIG. 4, is a cross-sectional view of the heat exchanger of FIG. 1, showing a flow path of the second fluid.

With reference to FIG. 4, the plate heat exchanger 1 has a first passage 51 that extends along the casing 10 and the first sides 24 of the heat transfer plates 20. The first passage 51 has a fluid outlet section 53 and fluid inlet section 54 that are separated from each other by a second fluid blocker 63.

The plate heat exchanger 1 has also a second passage 52, which extends along the casing 10 and the second sides 25 of the heat transfer plates 20. Thus, the second passage 52 is, as seen across the heat transfer plates 20, opposite the first passage 51. The second passage 52 has a fluid inlet section 56 and a fluid outlet section 57. The fluid inlet section 56 is arranged, as seen across the heat transfer plates 20, opposite the fluid outlet section 53 of the first passage 51. The fluid outlet section 57 of the second passage 52 is arranged, as seen across the heat transfer plates 20, opposite the fluid inlet section 54 of the first passage 51.

The first passage 51 has a second fluid outlet section 55 that is located next to its fluid inlet section 54. The second passage 52 has a second fluid inlet section 58 that is arranged, as seen across the heat transfer plates 20, opposite the second fluid outlet section 55 of the first passage 51. The second fluid inlet section 58 of the second passage 52 is separated from the fluid outlet section 57 of the second passage 52 by a fourth fluid blocker 64.

In detail, the first passage 51 is formed by a space between the first sides 24 of the heat transfer plates 20 and an interior surface 14 (see FIG. 5) of the cylindrical casing 11 that faces the first sides 24, between the top cover 12 and the bottom cover 13. The second passage 52 is formed by a corresponding space between the second sides 25 of the heat transfer plates 20 and surface 14' of the cylindrical casing 11 that faces the second sides 25, between the top cover 12 and the bottom cover 13.

The second fluid F2 enters the first passage 51 via the second heat exchanger inlet 5. The second fluid F2 next leaves the first passage 51 by flowing out from the first passage 51 via the fluid outlet section 53 of the first passage 51, into interspaces between the heat transfer plates 20, at the first sides 24 of the heat transfer plates 20 where the fluid entries 26 are located. All interspaces, or openings at the first sides 24 of the heat transfer plates 20, that are located between the bottom cover 13 and the plane P6 form the fluid outlet section 53 of the first passage 51. Thus, when the second fluid F2 flows out from the first passage 51, it flows into interspaces that are part of the second set of flow channels 32. The second fluid F2 then flows across heat transfer plates 20 and exits the heat transfer plates 20 at the inlet section 56 of the second passage 52, i.e. the second fluid F2 flows into the second passage 52 at its fluid inlet section 56. All interspaces, or openings at the second sides 25 of the heat transfer plates 20 that are located between the bottom cover 13 and the plane P6 form the fluid inlet section 56 for the second passage 52.

After the second fluid F2 has entered the second passage 52 via the fluid inlet section 56, it flows in the second passage 52, towards the fluid outlet section 57 of the second passage 52. All interspaces, or openings at second side openings 25 of the heat transfer plates 20 that are located between plane P6 and the fourth fluid blocker 64, or plane P7, form the fluid outlet section 57 of the second passage 52. The second fluid F2 flows out from the second passage 52, into the interspaces of the fluid outlet section 57, across heat transfer plates 20 and exits the interspaces via the fluid inlet section 54 of the first passage 51. All interspaces, or openings at the first sides 24 of the heat transfer plates 20 that are located between the plane P6 and plane P7, form the fluid inlet section 54 of the first passage 51.

When the second fluid F2 has entered the first passage 51 via the fluid inlet section 54, it flows in the first passage 51, towards the second fluid outlet section 55 of the second passage 52. All interspaces, or openings at first sides 24 of the heat transfer plates 20 that are located between plane P7 and the top cover 12 form the second fluid outlet section 55 of the first passage 51. The second fluid F2 flows via the second fluid outlet section 55 out from the first passage 51, into the interspaces at the second fluid outlet section 55, across heat transfer plates 20 and exits the interspaces via the second fluid inlet section 58 of the second passage 52. All interspaces, or openings at the second side opening 25 of the heat transfer plates 20 that are located between the plane P7 and the top cover 12 form the second fluid inlet section 58 of the second passage 52. After the second fluid F2 has flown into the second passage 52 at the second fluid inlet section 58, it exits the second passage 52 via the second heat exchanger outlet 6.

The flow path of the second fluid F2 is illustrated by the curved arrow marked with reference numeral "F2".

As may be seen, the planes P4-P7 are defined by the fluid blockers 61-64. Specifically, plane P4 coincides with the first fluid blocker 61, plane P6 coincides with the second fluid blocker 63, plane P5 coincides with the third fluid blocker 62 and plane P7 coincides with the fourth fluid blocker 64.

The plate heat exchanger 1 represents one possible embodiment of a plate heat exchanger with first and second distribution tubes respectively first and second passages for a first and a second fluid. The described embodiment has a multipass configuration and is typically used in a so called a single phase application. In other embodiments, for example when the heat exchanger is used in a condenser or reboiler application, then a single pass configuration may be used. The inlets and outlets for the second fluid may then be located at the center of the shell.

Figure 11:
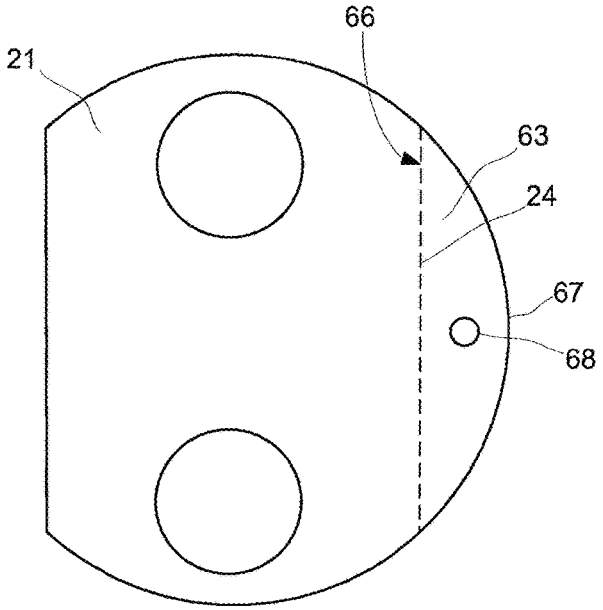
FIG. 11 is a top view of a first embodiment of a fluid blocker that may be used for the heat exchanger of FIG. 1.
Figure 12:
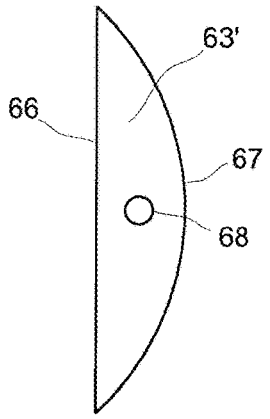
FIG. 12 is a top view of a second embodiment of a fluid blocker that may be used for the heat exchanger of FIG. 1, FIGS. 13-15 are principal views that illustrate a by-pass blocker that may be used for the heat exchanger of FIG. 1

With reference to FIG. 11 the second fluid blocker 63, or baffle, may be an integral part of a heat transfer plate 21, with a peripheral edge 67 that abuts or are very close to the interior surface 14 (see FIG. 5) of the cylindrical casing 11, and with a peripheral edge section 66 that is joined with the first side opening 24 of the heat transfer plate 21. The second fluid blocker 63 may also have the form of a partial disc, as shown by the fluid blocker 63' of FIG. 12. The fluid blocker 63' also has peripheral edges 66, 67 that extend along the first side opening 24 of the heat transfer plate 21 and along the inner surface 14 of the casing 10.

To support the second fluid blocker 63 the plate heat exchanger 1 may have a rod 69 (see FIG. 4) that extends along the first passage 51, from an interior support surface 15 of the casing 10 and to the second fluid blocker 63. The support surface 15 may be part of the end plate 19, or the bottom cover 13 in case no end plate is used. The rod 69 may typically extend from the support surface 15 and to a similar support surface on the other end plate 18, or on the top cover 12 in case no end plates are used. The rod 69 may then extend through a through hole 68 (see FIGS. 11 and 12) in the second fluid blocker 63, 63' and is, e.g. by a spot weld, connected to the second fluid blocker 63, 63'. This effectively accomplishes a support for the second fluid blocker 63, 63', in a direction along the first passage 51. A similar rod may be arranged in the second passage 52 for supporting the fourth fluid blocker 64.

Turning back to FIG. 5 and with further reference to FIGS. 6-8, the heat transfer plate 21 that may be used for the heat exchanger 1 of FIG. 1 is shown. The heat transfer plate 21 has a number of rows 73, 74 where each row 73, 74 comprises alternating tops and grooves, such as top 76 and groove 77 of row 73 and top 76' and groove 77' of row 74. The rows 73, 74 extend along a central plane P1 of heat transfer plate 21, between a top plane P2 and a bottom plane P3 of the heat transfer plate 21. The central plane P1 is typically a plane that extends in the center of the heat transfer plate 21, in the illustrated embodiment at equal distances from a top side of the heat transfer plate and a bottom side of the heat transfer plate 21. The top plane P2 and bottom plane P3 are substantially parallel to the central plane P1 and are located on a respective side of the central plane P1.

A transition between each top 76 and adjacent groove 77 in the same row 73 is formed by a portion 78 of the heat transfer plate 21 that is inclined relative the central plane P1. The row 74 has a corresponding inclined portion 78' between top 76' and groove 77'. Flat elongated plate portions 80, 81 extend along the central plane P1 of the heat transfer plate, between the rows 73, 74 of tops and grooves. The rows 73, 74 are thereby separated from each other. The flat elongated plate portions 80, 81 may be referred to as reinforcement sections or flow channels, i.e. the plate portions 80, 81 form flow channels between the rows 73, 74 of tops 76 and grooves 77. Generally, the central plane P1 is located in, or extends along, the center of the flat elongated plate portions 80, 81. The planes P1, P2 and P3 are seen from the side in FIG. 7.

The tops 76 have respective top surface 85 on a top side 88 of the heat transfer plate 21 and the grooves 77 have a respective bottom surface 86 on a bottom side 89 of the heat transfer plate 21. The top side 88 may be referred to as a first side 88 of the heat transfer plate 21 and the bottom side 89 may be referred to as a second side 89 of the heat transfer plate 21. The top surface 85 has a contact area that abuts a heat transfer plate that is arranged above (on the top side 88 of) the heat transfer plate 21. The bottom surface 86 has a contact area that abuts a heat transfer plate that is arranged below (on the bottom side 89 of) the heat transfer plate 21. For several, most or even all of the tops and grooves the contact area of the top surface 85 is larger than the contact area of the bottom surface 86. Some of the rows of alternating tops and grooves are parallel to the first side opening 24 and the second side opening 25 of the heat transfer plate 21.

Figure 9:
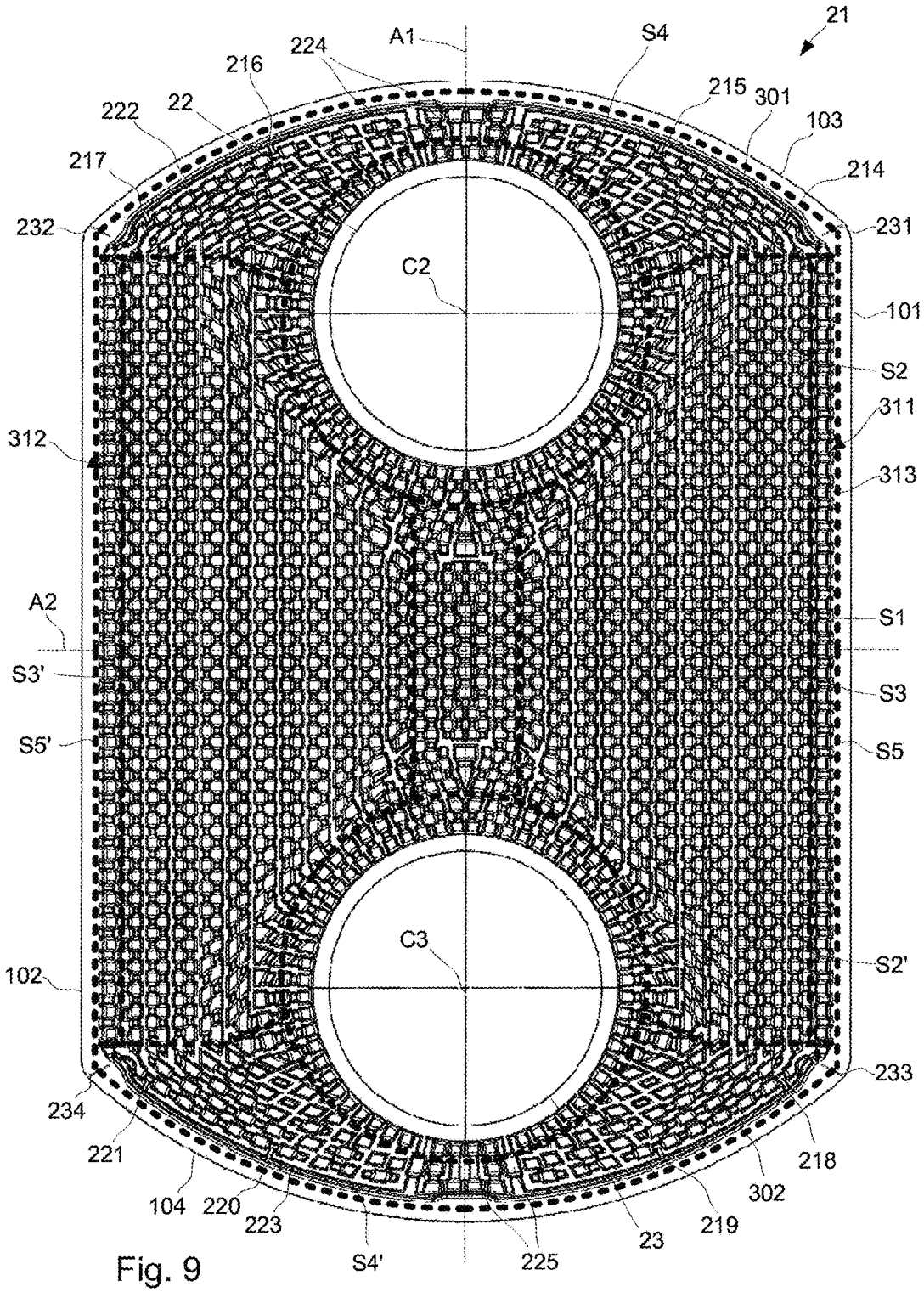
FIG. 9 is an enlarged view of the heat transfer plate shown in FIG. 5.
Figure 10:
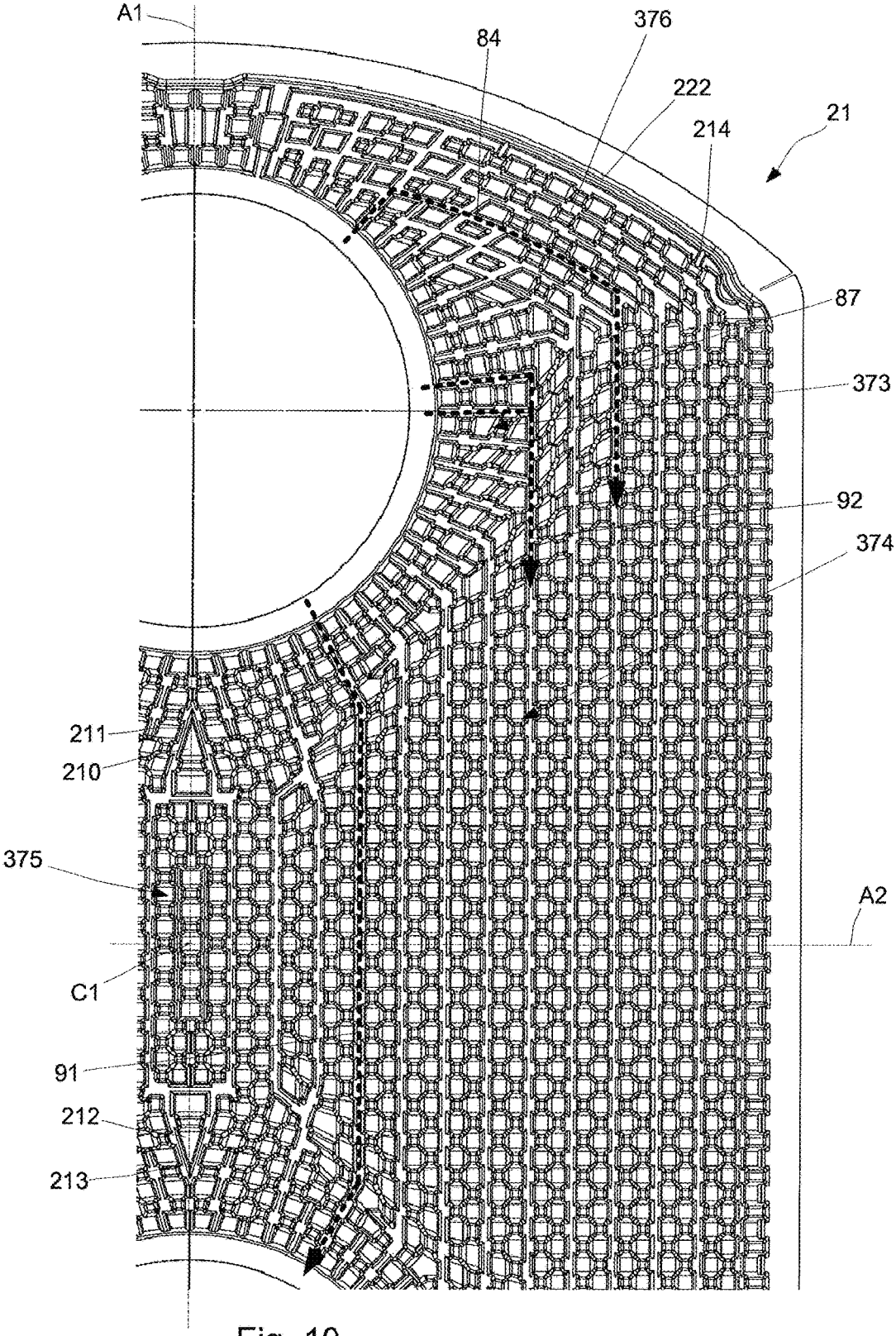
FIG. 10 is an enlarged, sectional view showing a quarter of the heat transfer plate of FIG. 5.

With reference to FIGS. 9 and 10 the heat transfer plate 21 is shown in greater detail and has different type of sections with different characteristics. A first section S1 of a first type is located in the center of the heat transfer plate 21. Two sections S2, S2' of a second type are located around the port openings 22, 23. Two sections S3, S3' of a third type are located at both sides of the first section S1. Two sections S4, S4' of a fourth type are located along the third side 103 and the fourth side 104, and two sections S5, S5' of a fifth type are located along the first side 101 and the second side 102.

Sections S2, S2' are similar and symmetrical about the axis A2, where axis A2 extend through the center C1 of the plate heat transfer plate 21 and is perpendicular to axis A1. Sections S3, S3' are similar and symmetrical about the axis A1. Sections S4, S4' are similar and symmetrical about the axis A2 while sections S5, S5' are similar and symmetrical about the axis A1.

In the first section S1 there are three rows of tops and grooves 375 that extend adjacent each other and symmetrically along axis A1, i.e. there is no plate portion that separates the three rows from each other. These rows of tops and grooves 375 form a central set of axially extending rows of tops and grooves 375.

The first section S1 has also a first fluid blocker 210 and a second fluid blocker 212 that are arranged on the top surface 88 of the heat transfer plate heat transfer plate 21. The fluid blockers 210, 212 are located between the first port opening 22 and the second port opening 23. The first fluid blocker 210 is wedge-shaped and has a tapered section 211 that faces the first port opening 22. The second fluid blocker 212 is also wedge-shaped and has also a tapered section 213 that faces the second port opening 23.

In the second section S2 a number of the rows of tops and grooves 373 extend in a direction radially outwards from the center C2 of the first port opening 22, thereby forming radially extending rows of tops and grooves 373. The radially extending rows of tops and grooves 373 surround a circumference of the first port opening 22. The section S2' has corresponding rows of tops and grooves.

In the third section S3 a number of the rows of tops and grooves 374 extend in a longitudinal direction, parallel to the axis A1, thereby forming longitudinally extending rows of tops and grooves 374. The section S3' has corresponding rows of tops and grooves.

In the fourth section S4 a number of the rows of tops and grooves 376 extend in parallel to the third side 103 and with a curvature, thereby forming curved rows of tops and grooves 376. The section S4' has corresponding rows of tops and grooves that extend along the fourth side 104.

In the fourth section S4 there is also a third fluid blocker 214 and in section S4' there is a fourth fluid blocker 218. Both of these fluids blockers 214, 218 are arranged on the bottom surface 89 of the heat transfer plate 21. The third fluid blocker 214 being located between the first port opening 22 and the third side 103, across a fluid channel 301 that extends along the third side third side 103. The fourth fluid blocker 218 is arranged between the second port opening 23 and the fourth side 104, across a fluid channel 302 that extends along the fourth side 104. To accomplish efficient blocking of the fluid channel 301, three additional fluid blockers 215, 216, 217 are arranged across the fluid channel 301, while three additional fluid blockers 219, 220, 221 are arranged across the fluid channel 302.

In the fourth section S4 there is a fifth fluid blocker 222 is arranged on the bottom surface 89 of the heat transfer plate 21 and extends along the third side 103. In the section S4' there is a sixth fluid blocker 223 that is arranged on the bottom surface 89 of the heat transfer plate 21 and extends along the fourth side 104.

The fourth section S4 has also a first flow reducer 224 while section S4' has a second flow reducer 225. Both flow reducers 224, 225 are arranged on the bottom surface 89 of the heat transfer plate 21. The first flow reducer 224 extends from the first port opening 22 to the third side third side 103, in section S4. The second flow reducer 225 extends from the second port opening 23 to the fourth side fourth side 104, in section S4'.

A number of the plate portions that separate the rows of tops and grooves extend first in a direction outwards from the first port opening 22, then in a direction that is parallel to the third side 103 and with a curvature, such that the plate portions comprises curved plate portions 84.

In the fifth section S5 there is a first side row 311 of tops 313 that are located along the first side opening 24, Section S5' has a second side row 312 of tops that are located along the second side opening 25. The tops 313 of the first and second side rows 311, 312 have a different pitch than the previously described tops 76 in the rows 73, 74 of tops 76 and grooves 77 that are separated from each other by the plate portions 80, 81 that form flow channels.

As may be seen from the figures, the heat transfer plate 21 has plate portions 87 (flow channels) that extend first in a direction outwards from the first port opening 22, then in a direction that is parallel to the third side 103, to continue with an extension in a direction that is parallel to a direction from the first port opening 22 to the second port opening 23. This plate portion 87, or flow channel 87, is indicated a dotted arrow in FIG. 10.

The heat transfer plate 21 has also plate portions (flow channels) that separate the rows of tops and grooves extend first in a radial direction outwards from the first port opening 22, then in a direction that is parallel to a direction from the first port opening 22 to the second port opening 23 or in a direction that is parallel to the first side 101, and finally in a radial direction inwards to the second port opening 23. This plate portion, or flow channel, is indicated by a dotted arrow 91 in FIG. 10.

The heat transfer plate 21 has also at least two plate portions (flow channels) that separate the rows of tops and grooves extend first in a respective radial direction outwards from the first port opening 22. These two flow channels joins with one flow channel that is parallel to a direction from the first port opening 22 to the second port opening 23, or in a direction that is parallel to the first side 101. These at least two radial plate portions and the flow channel they join into is indicated by dotted arrow 92 in FIG. 10.

Figure 13:
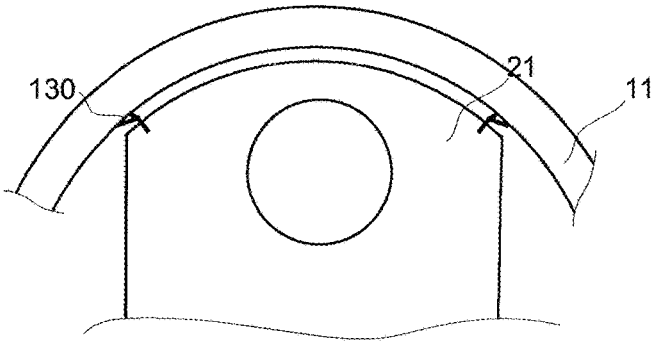
Figure 14:
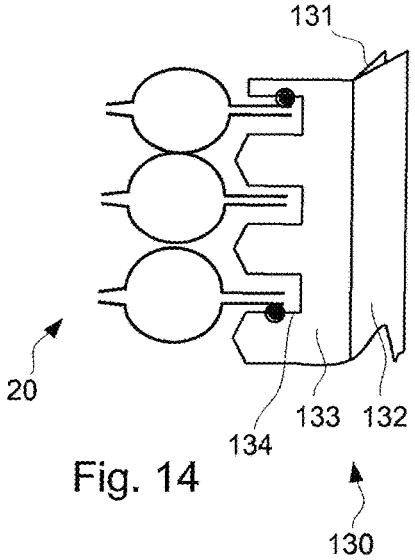
Figure 15:
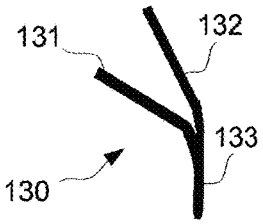

With reference to FIGS. 13-15, a third embodiment of a by-pass blocker 130 is illustrated. The by-pass blocker 130 is located on the heat transfer plates 20 where the heat transfer plates 20 meet the cylindrical casing 11, and prevents the second fluid F2 from taking a short-cut between the heat transfer plates 20 and the inner surface of the cylindrical casing 11 when it flows between the first passage 51 and second passage 52, or when it flows in the opposite direction. The by-pass blocker 130 comprises a comb-like structure 133 that extends along the heat transfer plates 20, from the top cover 12 to the bottom cover 13. The comb-like structure 133 has gaps 134 into which the edges of the heat transfer plates 20 extends, and is attached to the heat transfer plates 20 by spot-welds. The gaps of the comb are typically abutting the edges of the heat transfer plates 20, such that a tight seal may be accomplished. Any remaining gaps may be closed by welding. From the comb-like structure 133 a first seal 131 and a second seal 132 extends. These seals 131, 132 are flexible such that they closely abut the interior surface of the cylindrical casing 11, when the by-pass blocker 130 is arranged between the heat transfer plates 20 and the cylindrical casing 11.

For providing a good fit between the by-pass blocker 130 and the heat transfer plates, the heat transfer plate 21 may in its third side 103 have two cut-outs 231, 232 and the fourth side 104 may have two cut-outs 233, 234. Each of these cut-outs 231, 232, 233, 234 receives a respective sealing element like element 130. The cut-outs in the plate fit into the gaps 134 of the comb-like structure 133.

Figure 16:
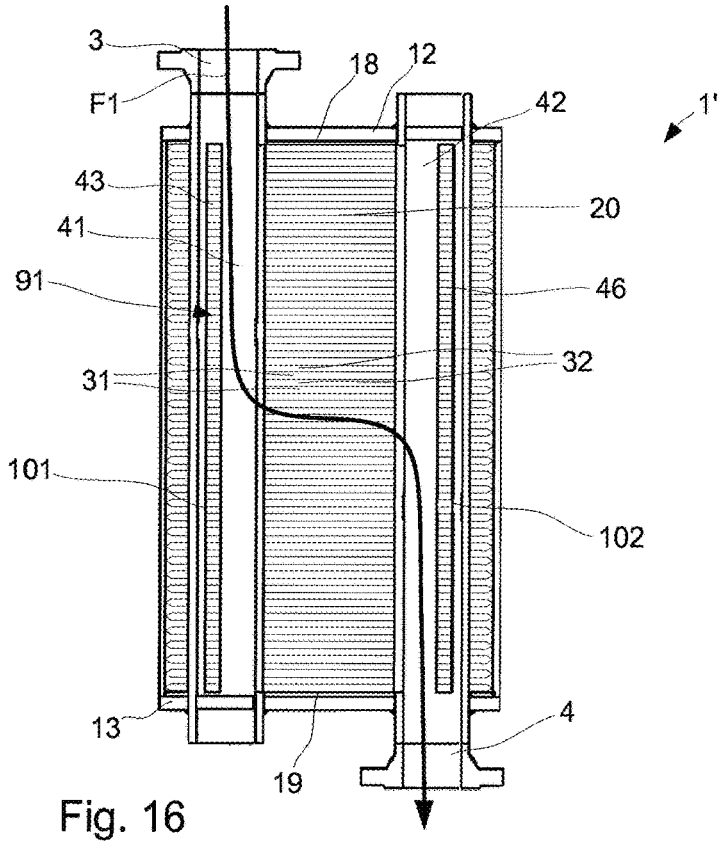
FIG. 16, is a first cross-sectional view of another embodiment of a plate heat exchanger, showing a flow path of a first fluid.
Figure 17:
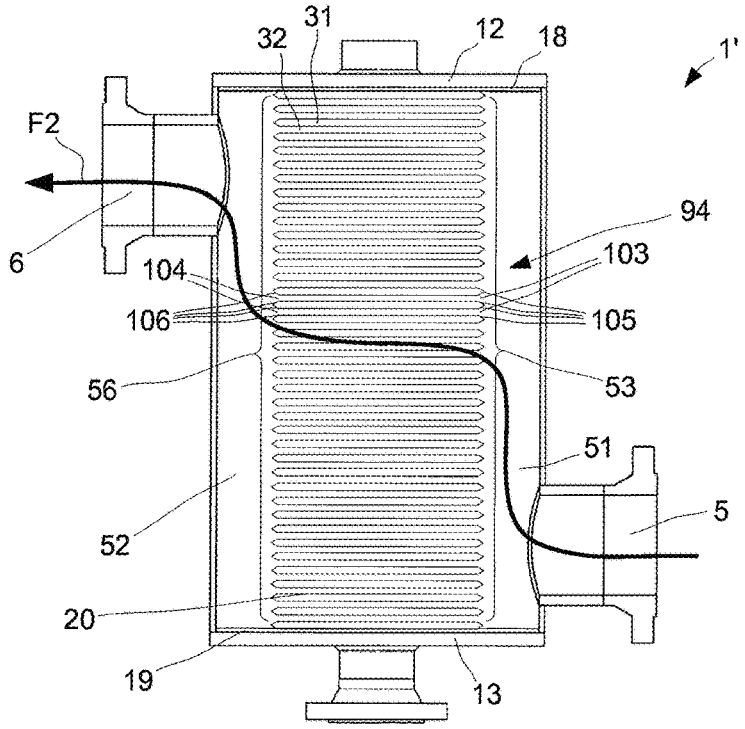
FIG. 17, is a second cross-sectional view of the heat exchanger of FIG. 18, showing a flow path of a second fluid.

With reference to FIGS. 16 and 17, another embodiment of a plate heat exchanger 1' is illustrated. This heat exchanger 1' is similar to the heat exchanger 1 shown in e.g. FIGS. 3 and 4, but with the difference that it has a single pass configuration for both the first fluid F1 and the second fluid F2. This means that each of the fluids F1, F2 passes between the heat transfer plates 20 only once, as compared to three times in the heat exchanger 1 of FIGS. 3 and 4, which hence has a three pass configuration.

In detail, the heat exchanger 1' has a first distribution tube 41 that extends through the first port openings 22 of the heat transfer plates 20. The first distribution tube 41 and has a fluid inlet 3 and a fluid outlet 43. The fluid inlet 3 is a conventional tube inlet that is located at an end of the first distribution tube 41 and the fluid outlet 43 has the shape of an elongated opening, or through hole, that extends along a length of the first distribution tube 41.

The plate heat exchanger 1' has second distribution tube 42 that extends through the second port openings 23 of the heat transfer plates 20. The second distribution tube 42 and has a fluid inlet 46 and a fluid outlet 4. The fluid outlet 4 is a conventional tube outlet that is located at an end of the second distribution tube 42 and the fluid inlet 46 has the shape of an elongated opening, or through hole, that extends along a length of the second distribution tube 42. The fluid inlet 46 of the second distribution tube 42 is arranged, as seen across the heat transfer plates 20, opposite the fluid outlet 43 of the first distribution tube 41. The plate heat exchanger 1' has in its distribution tubes no fluid blockers like the fluid blockers 61 and 62 described above. All other features are same, but the absence of fluid blockers provides another flow path for the first fluid that results in a one pass configuration. The absence of fluid blockers give a general flow path of the first fluid F1 as illustrated by the curved arrow marked with reference numeral "F1".

The plate heat exchangers 1 and 1' of FIGS. 3 and 4 respectively FIGS. 18 and 19 each share the same concept in form of first and second distribution tubes 41, 42 that extends through the port openings 22, 23 of the heat transfer plates 20. The first distribution tube 41 comprises the fluid inlet 3 for the first fluid F1, and the fluid outlet 43, which faces at least a section 91 of the first set of flow channels 31. The first fluid F1 may then leave the first distribution tube 41 and enter said section 91 of the first set of flow channels 31.

In a one pass configuration the section 91 typically comprises the flow channels for the first fluid F1 for all heat transfer plates.

The second distribution tube 42 extends through the second port openings 23 of the heat transfer plates 20 and comprises the fluid inlet 46, which faces the above mentioned section 91 of the first set of flow channels 31, such that the first fluid F1 may leave said section 91 of the first set of flow channels 31 and enter the second distribution tube 42. The second distribution tube 42 has also the fluid outlet 4 for the first fluid F1.

Since the plate heat exchanger 1' of FIGS. 18 and 19 has no fluid blockers, there is only one section 91 of the first set of flow channels 31. Both the outlet 43 and the inlet 46 faces the section 91. The plate heat exchanger 1 of FIGS. 3 and 4 has two fluid blockers for the first fluid F1 and thus three sections 91, 92, 93 of the first set of flow channels 31. Each section 91, 92, 93 represents one fluid pass for the first fluid F1.

Other embodiments are conceivable. For example, in a two pass configuration the heat exchanger has the first fluid blocker 61 but not the second fluid blocker 62. The first fluid blocker may then be located in the middle of the first distribution tube. The outlet of the second distribution tube 42 would then be an outlet that faces a second section of the first set of flow channels 31, and the first distribution tube 41 would then have an outlet similar to fluid outlet 4 shown in FIG. 3.

The plate heat exchanger 1' has a first passage 51 that extends along the casing 10 and the first sides 24 of the heat transfer plates 20. The first passage 51 has a fluid outlet section 53. The plate heat exchanger 1' has also a second passage 52, which extends along the casing 10 and the second sides 25 of the heat transfer plates 20. The second passage 52 is, as seen across the heat transfer plates 20, opposite the first passage 51. The second passage 52 has a fluid inlet section 56. The first passage 51 has a fluid inlet 5 and the second passage 52 has a fluid outlet 6.

The plate heat exchanger 1' has in its passages 51, 52 no fluid blockers like the fluid blockers 63 and 64 previously described. All other features are same, but the absence of fluid blockers provides another flow path for the second fluid that results in a one pass configuration. The absence of fluid blockers gives a general flow path of the second fluid F2 as illustrated by the curved arrow marked with reference numeral "F2".

The plate heat exchangers 1 and 1' of FIGS. 3 and 4 respectively FIGS. 18 and 19 each share the same concept in form of passages 51, 52 that extends along the sides of the heat transfer plates 20. The first passage 51 comprises a fluid inlet 5 for the second fluid F2, and a fluid outlet section 53 that faces a section 94 of the second set of flow channels 32. The second fluid F2 may then leave the first passage 51 and enter said section 94 of the second set of flow channels 32.

The second passage 52 has a fluid inlet section 56 that faces said section 94 of the second set of flow channels 32, such that the second fluid F2 may leave said section 94 of the second set of flow channels 32 and enter the second passage 52. The second passage 52 has also the fluid outlet 6 for the second fluid F2.

Since the plate heat exchanger 1' of FIGS. 18 and 19 has no fluid blockers in its passages 51, 52, there is only one section 94 of the second set of flow channels 31. The plate heat exchanger 1 of FIGS. 3 and 4 has two fluid blockers for its passages and has thus three sections 94, 95, 96 of the second set of flow channels 32. Each section 94, 95, 96 represents one fluid pass for the second fluid F2.

Other embodiments are conceivable. For example, in a two pass configuration for the second fluid the heat exchanger has the fluid blocker 63 (see FIG. 4) but not the fluid blocker 64. The fluid blocker is then typically arranged in the middle of the second passage 52. The outlet of the second passage 52 would then be an outlet that faces a second section of the second set of flow channels 32, and the first passage 51 would then have an outlet similar to fluid outlet 6 shown in FIG. 4.

It is possible to have a different number of passages for the first and second fluids, e.g. one pass for the first fluid and two passes for the second fluid.

As indicated, the fluid outlet 43 of the first distribution tube 41 has the form of an opening 101 and the fluid inlet 46 of the second distribution tube 42 has the form of a similar opening 102. Thus, the distribution tubes 41, 42 each have at least one opening 101, 102 (through hole in the tube), and these openings 101, 102 are openings to the same flow channels of the first set of flow channels 31. The outlets and inlets in the distribution tubes of the embodiment shown in FIGS. 3 and 4 have corresponding openings.

The fluid outlet 53 of the first passage 51 and the fluid inlet 56 of the second passage 52 have at least one respective opening in form of interspaces 103, 104 at opposite, peripheral edges 105, 106 of the heat transfer plates. These interspaces 103, 104, or gaps, provide fluid access to the same flow channels of the second set of flow channels 32. The inlets and outlets 54, 55, 57, 58 shown in FIG. 4 are also formed by corresponding interspaces, or gaps, between the heat transfer plates.

From above follows that, for a two pass configuration, for the first fluid the first distribution tube comprises a further (second) fluid inlet and a further (second) fluid outlet for the first fluid. The further inlet is similar to the inlet 44 of FIG. 3 and the outlet is then an outlet similar to the outlet 4 shown in FIG. 3, but arranged on the first distribution tube. A fluid blocker like the blocker 61 separates the further fluid inlet from the (first) fluid outlet of the first distribution tube, such that the further fluid inlet faces at least a further (second) section of the first set of flow channels. The fluid outlet of the second distribution tube then faces said further section of the first set of flow channels, such that the first fluid may leave the second distribution tube and enter said further section of the first set of flow channels, and leave said further section of the first set of flow channels and enter the first distribution tube via its further fluid inlet.

For the two pass configuration the first passage comprises a further fluid inlet, a further fluid outlet for the second fluid, and a fluid blocker that separates the further fluid inlet from the fluid outlet of the first passage. The further outlet is then an outlet similar to the outlet 6 shown in FIG. 3, but arranged on the first passage. The further fluid inlet faces at least a further section of the second set of flow channels. The fluid outlet of the second passage faces said further section of the second set of flow channels, such that the second fluid may leave the second passage and enter said further section of the second set of flow channels, and leave said further section of the second set of flow channels and enter the first passage via its further fluid inlet.

For the three pass configuration of FIGS. 3 and 4 with the fluid blocker 62, the further (second) outlet of the first distribution tube 41 is the outlet 45, while the second distribution tube 42 has a further inlet 48 an a further outlet 4. With the fluid blocker 64 the further (second) outlet of the first passage 51 is the outlet 55, while the second passage 52 has a further inlet 58 and a further outlet 6.

From the description above follows that, although various embodiments of the invention have been described and shown, the invention is not restricted thereto, but may also be embodied in other ways within the scope of the subject-matter defined in the following claims. For example, the plate heat exchanger may be arranged with a different number of fluid blockers and other locations of the heat exchanger fluid inlets and outlets. Thus, even though three so called passes for the fluids are illustrated, another number of passes for the fluids may be accomplished just as well.

The invention claimed is:

1. A heat transfer plate configured to be arranged in a plate heat exchanger, the heat transfer plate comprising a first side, a second side, a third side and a fourth side that form a periphery of the heat transfer plate, the first side being opposite to the second side and the third side being opposite to the fourth side, a first port opening and a second port opening that are arranged at a distance from each other for allowing a first fluid to flow over a top surface of the heat transfer plate, from the first port opening to the second port opening, wherein an axis of the heat transfer plate extends through a center of the first port opening and through a center of the second port opening, a first side opening at the first side and a second side opening at the second side, for allowing a second fluid to flow over a bottom surface of the heat transfer plate, from the first side opening to the second side opening, a number of rows where each row has alternating tops and grooves that extend along a central plane of the heat transfer plate, between a top plane and a bottom plane of the heat transfer plate, the top plane and bottom plane being substantially parallel to the central plane and located on a respective side of the central plane, where a transition between a top and an adjacent groove in the same row is formed by a portion of the heat transfer plate that is inclined relative the central plane, plate portions that extend along the central plane of the heat transfer plate, between the rows of tops and grooves, such that at least some of the rows of tops and grooves are separated from each other and the plate portions thereby form flow channels between the rows of tops and grooves, and a first side row of tops located alone the first side opening, and a second side row of tops located along the second side opening, wherein the tops of the first and second side rows have a different pitch than the tops in the rows of tops and grooves that are separated from each other by the plate portions that form flow channels.

2. A heat transfer plate according to claim 1, having the shape of a circular plate with two cut sides that form the first side and the second side, wherein the third side and the fourth side have the form of curved sides.

3. A heat transfer plate according to claim 1, wherein at least three of the rows of tops and grooves extend adjacent each other, symmetrically along the axis that extends through the centers of the first and second port openings, thereby forming a central set of axially extending rows of tops and grooves.

4. A heat transfer plate according to claim 1, wherein a number of the rows of tops and grooves extend in a direction radially outwards from a center of the first port opening, thereby forming radially extending rows of tops and grooves.

5. A heat transfer plate according to claim 4, wherein the radially extending rows of tops and grooves surrounds a circumference of the first port opening.

6. A heat transfer plate according to claim 1, wherein a number of the rows of tops and grooves extend in a longitudinal direction, parallel to the axis that extends through the centers of the first and second port openings, thereby forming longitudinally extending rows of tops and grooves.

7. A heat transfer plate according to claim 1, wherein a number of the rows of tops and grooves extend in parallel to the third side and with a curvature, thereby forming curved rows of tops and grooves.

8. A heat transfer plate according to claim 1, comprising a first fluid blocker and a second fluid blocker that are arranged on the top surface of the heat transfer plate and located between the first port opening and the second port opening, wherein the first fluid blocker is wedge-shaped and has a tapered section that faces the first port opening, and the second fluid blocker is wedge-shaped and has a tapered section that faces the second port opening.

9. A heat transfer plate according to claim 1, comprising one fluid blocker and an other fluid blocker that are arranged on the bottom surface of the heat transfer plate, the one fluid blocker being arranged between the first port opening and the third side, across a fluid channel that extends along the third side, and the other fluid blocker being arranged between the second port opening and the fourth side, across a fluid channel that extends along the fourth side.

10. A heat transfer plate according to claim 1, comprising one fluid blocker and an other fluid blocker that are arranged on the bottom surface of the heat transfer plate, the one fluid blocker extending along the third side, and the other fluid blocker extending along the fourth side.

11. A heat transfer plate according to claim 1, comprising a first flow reducer and a second flow reducer that are arranged on the bottom surface of the heat transfer plate, the first flow reducer extending from the first port opening to the third side, the second flow reducer extending from the second port opening to the fourth side.

12. A heat transfer plate according to claim 1, wherein a number of the plate portions that separate the rows of tops and grooves extend first in a direction outwards from the first port opening, then in a direction that is parallel to the third side and with a curvature, such that the plate portions comprises curved plate portions.

13. A heat transfer plate according to claim 12, wherein the number of the plate portions that extend first in a direction outwards from the first port opening, and then in a direction that is parallel to the third side, continues with an extension in a direction that is parallel to a direction from the first port opening to the second port opening.

14. A heat transfer plate according to claim 1, wherein the third side comprises two cut-outs and the fourth side comprises two cut-outs, each of the cut-outs being arranged for receiving a respective sealing element that provides a seal between the plate and a plate heat exchanger casing in which the heat transfer plate is arranged.

15. A heat transfer plate according to claim 1, wherein the first, second, third and fourth sides are configured to be sealed with corresponding sides of a similar heat transfer plate that is located at the top side of the heat transfer plate, and the first and second openings are configured to be sealed with corresponding openings of a similar heat transfer plate that is located at a bottom side of the heat transfer plate.

16. A plate heat exchanger comprising a number of heat transfer plates, each heat transfer plate comprising:

a first side, a second side, a third side and a fourth side that form a periphery of the heat transfer plate, the first side being opposite to the second side and the third side being opposite to the fourth side, a first port opening and a second port opening that are arranged at a distance from each other for allowing a first fluid to flow over a top surface of the heat transfer plate, from the first port opening to the second port opening, wherein an axis of the heat transfer plate extends through a center of the first port opening and through a center of the second port opening, a first side opening at the first side and a second side opening at the second side, for allowing a second fluid to flow over a bottom surface of the heat transfer plate, from the first side opening to the second side opening, a number of rows where each row has alternating tops and grooves that extend along a central plane of the heat transfer plate, between a top plane and a bottom plane of the heat transfer plate, the top plane and bottom plane being substantially parallel to the central plane and located on a respective side of the central plane, where a transition between a top and an adjacent groove in the same row is formed by a portion of the heat transfer plate that is inclined relative the central plane, and plate portions that extend along the central plane of the heat transfer plate, between the rows of tops and grooves, such that at least some of the rows of tops and grooves are separated from each other and the plate portions thereby form flow channels between the rows of tops and grooves, wherein the heat transfer plates are arranged within a casing and permanently joined to each other such that:

a first set of flow channels for a first fluid is formed by every second interspace between the heat transfer plates, with fluid entries and fluid exits at the first and the second port openings, a second set of flow channels for a second fluid is formed by every other, second interspace between the heat transfer plates, with fluid entries and fluid exits at the first and second side openings, a first distribution tube that extends through the first port openings of the heat transfer plates and comprises: a fluid inlet for the first fluid; and a fluid outlet that faces at least a section of the first set of flow channels, such that the first fluid may leave the first distribution tube and enter said section of the first set of flow channels, a second distribution tube that extends through the second port openings of the heat transfer plates and comprises: a fluid inlet that faces said section of the first set of flow channels, such that the first fluid may leave said section of the first set of flow channels and enter the second distribution tube; and a fluid outlet for the first fluid, a first passage that extends along the casing and the first sides of the heat transfer plates and comprises: a fluid inlet for the second fluid; and a fluid outlet that faces at least a section of the second set of flow channels, such that the second fluid may leave the first passage and enter said section of the second set of flow channels, and a second passage that extends along the casing and the second sides of the heat transfer plates and comprises: a fluid inlet that faces said section of the second set of flow channels, such that the second fluid may leave said section of the second set of flow channels and enter the second passage; and a fluid outlet for the second fluid.

17. A heat transfer plate configured to be arranged in a plate heat exchanger, the heat transfer plate possessing a central plane and a periphery, the heat transfer plate comprising:

a first side, a second side, a third side and a fourth side that form the periphery of the heat transfer plate, the first side being opposite to the second side and the third side being opposite to the fourth side;

a first port opening and a second port opening that are arranged at a distance from each other for allowing a first fluid to flow over a top surface of the heat transfer plate from the first port opening to the second port opening, the first port opening passing through the heat transfer plate and possessing a center, the second port opening passing through the heat transfer plate and possessing a center;

an axis of the heat transfer plate lying in the central plane, extending through the center of the first port opening and through the center of the second port opening, and intersecting the third and fourth sides;

a first side opening at the first side of the heat transfer plate and a second side opening at the second side of the heat transfer plate, for allowing a second fluid to flow over a bottom surface of the heat transfer plate, from the first side opening to the second side opening;

plural rows on the top surface of the heat transfer plate and on the bottom surface of the heat transfer plate, each row including alternating tops and grooves that extend along a central plane of the heat transfer plate, between a top plane and a bottom plane of the heat transfer plate, the top plane and bottom plane being substantially parallel to the central plane and located on a respective side of the central plane, where a transition between a top and an adjacent groove in the same row is formed by a portion of the heat transfer plate that is inclined relative the central plane, each of the plural rows extending from adjacent the third side of the heat transfer plate to adjacent the fourth side of the heat transfer plate; and plate portions that extend along the central plane of the heat transfer plate, between the rows of tops and grooves, such that at least some of the rows of tops and grooves are separated from each other by the plate portions, and the plate portions thereby form flow channels between the rows of tops and grooves, each of the plate portions extending from adjacent the third side of the heat transfer plate to adjacent the fourth side of the heat transfer plate.

18. A heat transfer plate configured to be arranged in a plate heat exchanger, the heat transfer plate comprising a first side, a second side, a third side and a fourth side that form a periphery of the heat transfer plate, the first side being opposite to the second side and the third side being opposite to the fourth side, a first port opening and a second port opening that are arranged at a distance from each other for allowing a first fluid to flow over a top surface of the heat transfer plate, from the first port opening to the second port opening, wherein an axis of the heat transfer plate extends through a center of the first port opening and through a center of the second port opening, a first side opening at the first side and a second side opening at the second side, for allowing a second fluid to flow over a bottom surface of the heat transfer plate, from the first side opening to the second side opening, a number of rows where each row has alternating tops and grooves that extend along a central plane of the heat transfer plate, between a top plane and a bottom plane of the heat transfer plate, the top plane and bottom plane being substantially parallel to the central plane and located on a respective side of the central plane, where a transition between a top and an adjacent groove in the same row is formed by a portion of the heat transfer plate that is inclined relative the central plane, plate portions that extend along the central plane of the heat transfer plate, between the rows of tops and grooves, such that at least some of the rows of tops and grooves are separated from each other and the plate portions thereby form flow channels between the rows of tops and grooves, and a number of the plate portions that separate the rows of tops and grooves extend first in a radial direction outwards from the first port opening, then in a direction that is parallel to a direction from the first port opening to the second port opening, and finally in a radial direction inwards to the second port opening.

* * * * *